US006825601B2

(12) United States Patent
Yamauchi et al.

(10) Patent No.: US 6,825,601 B2
(45) Date of Patent: Nov. 30, 2004

(54) COLOR CATHODE-RAY TUBE

(75) Inventors: Naoki Yamauchi, Takatsuki (JP); Jun Araya, Takatsuki (JP); Hideo Iguchi, Osaka (JP); Yoshimi Kumei, Ibaraki (JP); Masaki Kawasaki, Toyonaka (JP); Yoko Kannan, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/363,610

(22) PCT Filed: Mar. 15, 2002

(86) PCT No.: PCT/JP02/02458

§ 371 (c)(1),
(2), (4) Date: Mar. 4, 2003

(87) PCT Pub. No.: WO02/075769

PCT Pub. Date: Sep. 26, 2002

(65) Prior Publication Data

US 2003/0178929 A1 Sep. 25, 2003

(30) Foreign Application Priority Data

Mar. 19, 2001 (JP) ..... 2001-077895
Sep. 26, 2001 (JP) ..... 2001-294625

(51) Int. Cl.[7] ..... H01J 29/80
(52) U.S. Cl. ..... 313/407; 313/402
(58) Field of Search ..... 313/402, 405, 313/407

(56) References Cited

FOREIGN PATENT DOCUMENTS

| | | |
|---|---|---|
| EP | 1 223 601 | 7/2002 |
| JP | 5-54818 | 3/1993 |
| JP | 10-302664 | 11/1998 |
| JP | 2001-192776 | 7/2001 |
| WO | WO 00/60635 | 10/2000 |

*Primary Examiner*—Vip Patel
(74) *Attorney, Agent, or Firm*—Merchant & Gould P.C.

(57) ABSTRACT

A color cathode-ray tube includes a shadow mask (20) stretched and held with tension applied thereto in one direction. The shadow mask is made of an Invar material. A stress generated in the shadow mask by the tension is 32 MPa or more in a range of ±20 mm with respect to a center position of the shadow mask in a direction orthogonal to a direction in which the tension is applied, and is 26 MPa or more outside the range. By stretching the shadow mask under this stress condition, magnetic shield characteristics are enhanced, and mislanding of an electron beam can be reduced. As a result, a satisfactory color image display can be obtained.

9 Claims, 11 Drawing Sheets

COLOR CATHODE-RAY TUBE

TECHNICAL FIELD

The present invention relates to a color cathode-ray tube. In particular, the present invention relates to a color cathode-ray tube having a shadow mask with tension applied thereto in one direction.

BACKGROUND ART

In a color cathode-ray tube, an electron beam emitted from an electron gun illuminates a phosphor screen formed on an inner surface of a face panel, whereby a desired image is displayed. A shadow mask that functions as a color selection electrode is provided on the electron gun side of the phosphor screen and spaced at a predetermined distance. In the shadow mask, a number of substantially rectangular (slot-shaped) apertures (electron beam apertures) are arranged so that an electron beam collides with a phosphor at a predetermined position.

An electron beam emitted from the electron gun is deflected by a deflecting apparatus and passes through a predetermined apertures of the shadow mask to illuminate a phosphor at a predetermined position, whereby a satisfactory color image is displayed. The phenomenon in which an electron beam illuminates a phosphor different from a desired phosphor is called "mislanding". When the mislanding occurs, deterioration of an image quality called a "color shift" is caused.

The mislanding is caused by various factors, and various countermeasures are adopted in accordance with the respective generation factors.

A first generation factor of the mislanding is doming. The doming refers to a phenomenon in which the shadow mask is heated when an electron beam passes through an aperture to cause thermal expansion of the shadow mask. Because of this, an aperture position is changed and an electron beam passing through the aperture does not correctly illuminate a phosphor at a predetermined position, thereby causing the mislanding. In order to prevent this, the shadow mask is previously provided with tension so as to absorb thermal expansion caused by an increase in temperature, and the shadow mask in this state is stretched and held on a frame. Because of such stretch holding, even if the temperature of the shadow mask is increased, a relative positional shift between the aperture of the shadow mask and the phosphor stripe formed on the phosphor screen can be reduced.

A second generation factor of the mislanding is an external magnetic field such as a geomagnetism. When an external magnetic field acts on an electron beam, the track of the electron beam is bent to cause the mislanding. The direction of an external magnetic field is varied depending upon the setting direction of a color cathode-ray tube, and the magnitude thereof is varied depending upon the location of the color cathode-ray tube. Therefore, in order to display an image stably at all times irrespective of the setting direction and the location of the color cathode-ray tube, it is required to shield an electron beam from an external magnetic field. For this purpose, in general, an internal magnetic shield is placed between the frame on which the shadow mask is stretched and the deflecting apparatus, and the internal magnetic shield, the frame, and the shadow mask are made of materials with satisfactory magnetic permeability. Because of this, an external magnetic field is absorbed by the internal magnetic shield, the frame and the shadow mask to pass to the inside of the materials thereof. Thus, the action of an external magnetic field on an electron beam can be reduced.

The material for the shadow mask is selected considering the above-mentioned thermal and magnetic characteristics and cost. In general, a Fe—Ni alloy (e.g., Invar material) or an iron (Fe) material (e.g., mild steel) is used. Among them, the Fe—Ni alloy is more expensive than the iron (Fe) material. However, the Fe—Ni alloy has a very small thermal expansion coefficient, so that it is effective for preventing the occurrence of the doming.

Furthermore, JP 10(1998)-302664 A describes the following: in the case where an aperture grill as a color selection electrode with tension applied thereto in one direction is stretched on a frame, the shape of the frame is designed so as to suppress a displacement amount in a tube axis direction of the aperture grill caused by thermal expansion, and simultaneously, the thickness of the frame in the tube axis direction is decreased to enhance a magnetic shield effect of an internal magnetic shield, whereby the mislanding of an electron beam can be reduced.

However, in a conventional color cathode-ray tube in which a shadow mask with tension applied thereto in one direction is stretched, the amount of mislanding of an electron beam caused by an external magnetic field such as a geomagnetism still may not be reduced sufficiently.

As a result of the earnest study of the cause for the above, it was found that the stress, which is applied to the shadow mask and the frame under the condition that the shadow mask is stretched, changes the magnetic characteristics of the shadow mask and the frame.

DISCLOSURE OF INVENTION

From the above point of view, it is an object of the present invention to provide a color cathode-ray tube in which the mislanding of an electron beam is unlikely to be caused by an external magnetic field, and consequently, a satisfactory color image display can be obtained.

In order to achieve the above-mentioned object, the present invention has the following configuration.

A first color cathode-ray tube of the present invention includes: a shadow mask on which a number of apertures for allowing an electron beam to pass through are formed; and a frame for stretching and holding the shadow mask with tension applied thereto in one direction, wherein the shadow mask is made of an Invar material, and a stress generated in the shadow mask by the tension is 32 MPa or more in a range of ±20 mm with respect to a center position of the shadow mask in a direction orthogonal to a direction in which the tension is applied, and is 26 MPa or more outside the range.

By setting a stress distribution in a direction orthogonal to a direction in which the tension of the shadow mask is applied as described above, a magnetic shield effect can be enhanced while a frame weight is suppressed. Therefore, a color cathode-ray tube can be provided in which mislanding and a color shift caused by the mislanding are unlikely to occur, the mislanding being caused by a change of a track of an electron beam due to the influence of an external magnetic field such as a geomagnetism that varies depending upon the direction of a screen and a geographic area of use. As a result, a satisfactory color image display can be obtained. Furthermore, by producing the shadow mask using an Invar material, mislanding of an electron beam caused by heating during use can be reduced.

A second color cathode-ray tube of the present invention includes: a shadow mask on which a number of apertures for allowing an electron beam to pass through are formed; and a frame for stretching and holding the shadow mask with tension applied thereto in one direction, wherein the shadow mask is made of a Fe—Ni alloy, and the shadow mask is stretched and held by an average tensile stress of 29 MPa or more.

By setting an average tensile stress while the shadow mask is stretched at 29 MPa or more, a color cathode-ray tube can be provided in which mislanding of an electron beam caused by an external magnetic field is unlikely to occur, and as a result, a satisfactory color image display can be obtained. Furthermore, by producing the shadow mask using a Fe—Ni alloy, mislanding of an electron beam by heating during use can be reduced.

In the above-mentioned second color cathode-ray tube, it is preferable that the shadow mask contains 36.1±0.3% Ni (nickel). Because of this, mislanding caused by heating during use further can be reduced.

Furthermore, in the second color cathode-ray tube, it is preferable that a member constituting a longitudinal side of the frame is made of a Fe—Ni alloy. By configuring the longitudinal side member, which directly stretches and holds the shadow mask, using the same kind of material as that of the shadow mask, the breakage and creases of the shadow mask caused by the difference in thermal expansion coefficient between the longitudinal side member and the shadow mask can be reduced.

Furthermore, in the above-mentioned second color cathode-ray tube, it is preferable that a member constituting the longitudinal side of the frame contains 36.1±0.3% Ni (nickel). Because of this, the thermal expansion of the longitudinal side member caused by an increase in temperature during use can be reduced, so that the breakage and creases of the shadow mask and the displacement of apertures can be suppressed.

In the above-mentioned first and second color cathode-ray tubes, it is preferable that an average tensile stress of the shadow mask is 90 MPa or less. Because of this, an increase in weight and cost caused by an increase in tensile stress can be minimized. Furthermore, the vibration damping property of the shadow mask can be prevented from being degraded.

In the above-mentioned first and second color cathode-ray tubes, it is preferable that a total defection angle is 115° or more. When the present invention is applied to a color picture tube with a total deflection angle of 115° or more, the effects of the present invention are exhibited more remarkably.

BEST MODE FOR CARRYING OUT THE INVENTION

Figure 1:
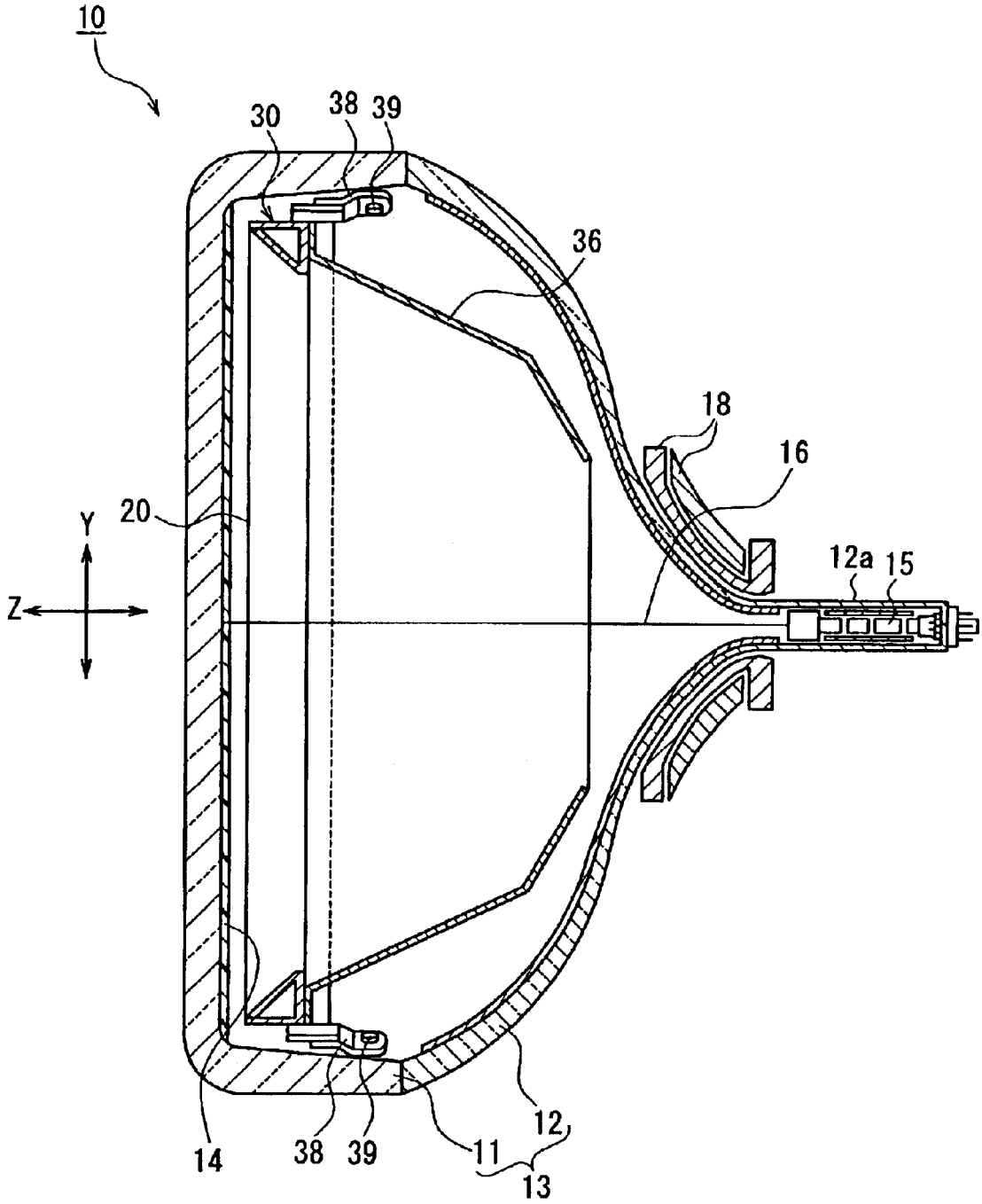
FIG. 1 is a cross-sectional view of a color cathode-ray tube of one embodiment according to the present invention in an up-and-down direction passing through a tube axis.

FIG. 1 is a cross-sectional view of a color cathode-ray tube 10 of the present invention in an up-and-down direction passing through a tube axis. For convenience of the following description, as shown in the figure, an XYZ-three-dimensional rectangular coordinate system is set in which a horizontal axis perpendicular to a tube axis is an X-axis, an axis in an up-and-down direction perpendicular to the tube axis is a Y-axis, and the tube axis is a Z-axis. Herein, the X-axis and the Y-axis cross each other on the tube axis (Z-axis).

A face panel 11 is integrated with a funnel 12 to form an envelope 13. A phosphor screen 14 is formed in a substantially rectangular shape on an inner surface of the face panel 11. A shadow mask 20 as a color selection electrode is stretched to be set on a frame 30 in a substantially rectangular frame shape so as to be away from and opposed to the phosphor screen 14. An internal magnetic shield 36 is integrated to a surface of the frame 30 on the opposite side of the shadow mask 20. The internal magnetic shield 36 is obtained by opposing and bonding two pairs of metal plate members, having a substantially trapezoidal shape, to each other so as to form a part of surfaces of a substantially quadrangular pyramid. The frame 30 with the shadow mask 20 stretched thereon and the internal magnetic shield 36 integrated therewith is held on the face panel 11 by engaging elastic supports 38 in a plate spring shape placed at four corners of the frame 30 with panel pins 39 embedded in the inner surface of the face panel 11. An electron gun 15 is contained in a neck portion 12*a* of the funnel 12.

A deflection yoke 18 is provided on an outer peripheral surface of the funnel 12 of the color cathode-ray tube 10 with the above-mentioned configuration to configure a color cathode-ray tube apparatus. An electron beam 16 from the electron gun 15 is deflected by a magnetic field from the deflection yoke 18 in a horizontal direction and a vertical direction, thereby scanning the phosphor screen 14.

Figure 2:
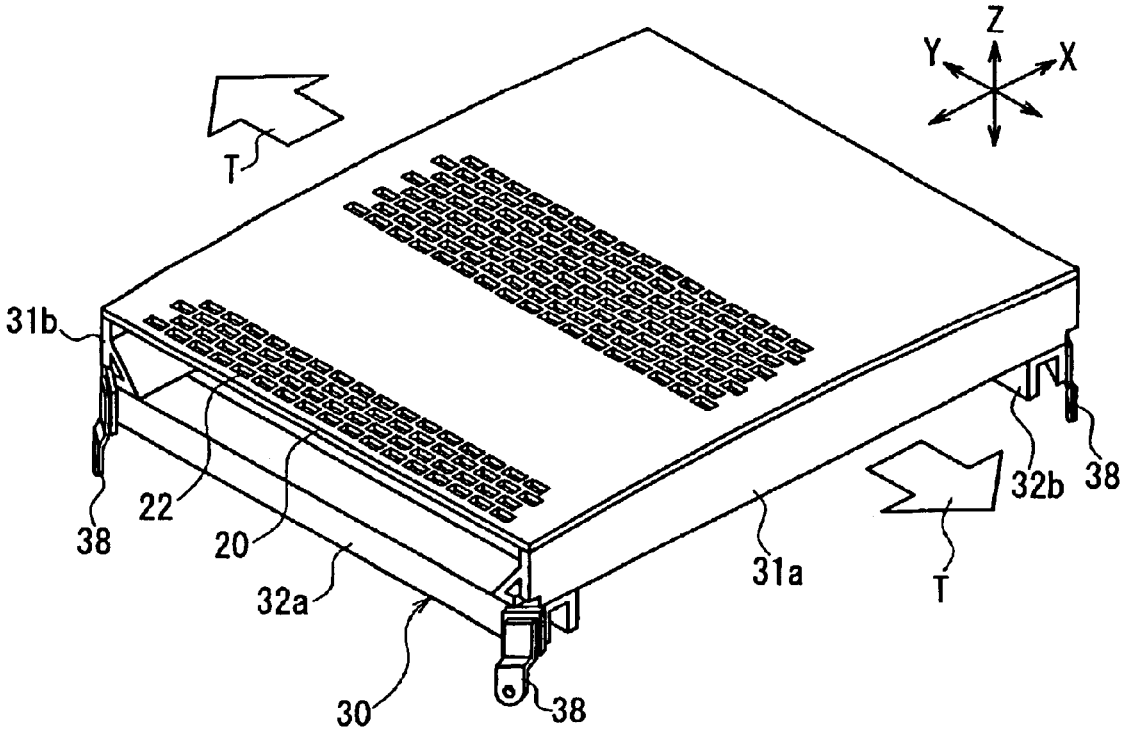
FIG. 2 is a perspective view schematically showing a configuration of a mask body structure composed of a shadow mask of the color cathode-ray tube of one embodiment according to the present invention and a frame for stretching and holding the shadow mask.

FIG. 2 is a perspective view schematically showing a configuration of a mask body structure composed of the shadow mask 20 and the frame 30 for stretching and holding the shadow mask 20.

As shown in the figure, the frame 30 is composed of a pair of supporting members 31*a* and 31*b* having a cross-section in a substantially triangular shape and a pair of connecting members 32*a* and 32*b* having a cross-section in a substantially "U" shape. A pair of the supporting members 31*a* and 31*b* and a pair of the connecting members 32*a* and 32*b* are placed respectively in parallel with and spaced from each other, and ends of the members are welded to each other, whereby the frame 30 in a substantially rectangular frame shape is configured.

The shadow mask 20 is made of a flat plate material in a substantially rectangular shape, and a number of slot-shaped apertures (through-holes, electron beam apertures) for allowing an electron beam to pass through are arranged regularly in the X-axis direction and the Y-axis direction (in FIG. 2, only a part of the apertures is shown). The apertures 22 can be formed by a well-known method (e.g., etching).

The shadow mask 20 is stretched on edges of a pair of the supporting members 31*a* and 31*b* that form longitudinal sides. The shadow mask 20 is stretched by welding the shadow mask 20 to the supporting members 31*a* and 31*b* under the condition that tension is applied to the shadow mask 20 in the Y-axis direction, and pressure in directions approaching each other is applied to the edges on the stretch side of a pair of the supporting members 31*a* and 31*b*. Because of this, the shadow mask 20 is stretched and held on the frame 30 under the condition that tension T is applied to the shadow mask 20 in a one-dimensional direction (Y-axis direction).

In the color cathode-ray tube of the present invention, as a material for the shadow mask 20, a Fe—Ni alloy (Invar is an example thereof) is used. The thickness of the shadow mask according to a tension method (in which the shadow mask with tension applied thereto is stretched) generally is set to be thin, i.e., about 1/10 of the thickness of the shadow mask (press mask) according to a press method (in which the shadow mask is press-molded to a predetermined shape, and held on the frame without applying tension) for the purpose of reducing tension to decrease the strength and weight of the frame. For example, the thickness of the press mask is about 1.2 mm, whereas the thickness of the tension mask is about 0.12 mm. Furthermore, according to the tension method, since the tension T is applied only in the Y-axis direction as shown in FIG. 2, a gap is formed between the shadow mask 20 and the connecting members 32*a* and 32*b* of the frame 30 at both edges in the X-axis direction. Thus, according to the tension method, the thickness of the shadow mask becomes thinner compared with that of the press method, and a gap is formed between the shadow mask and the frame at both edges in the X-axis direction. Therefore, a shield effect with respect to an external magnetic field in the tube axis (Z-axis) direction and the X-axis direction is decreased; as a result, mislanding is likely to occur and cause a color shift.

According to the present invention, in the tension method having the above-mentioned potential problems, it was found that the tension applied to the shadow mask influences the magnetic shield characteristics, and mislanding can be suppressed by defining tension to be applied so as to obtain satisfactory magnetic shield characteristics.

According to the present invention, a tensile stress generated in the shadow mask by the applied tension is defined from two aspects. The first aspect is based on the distribution of a stress in a direction (X-axis direction) orthogonal to a direction in which tension is applied (Embodiment 1 described later). The second aspect is based on an average value of a tensile stress (Embodiment 2 described later). Hereinafter, these aspects will be described in detail in this order.

(Embodiment 1)

Figure 3:
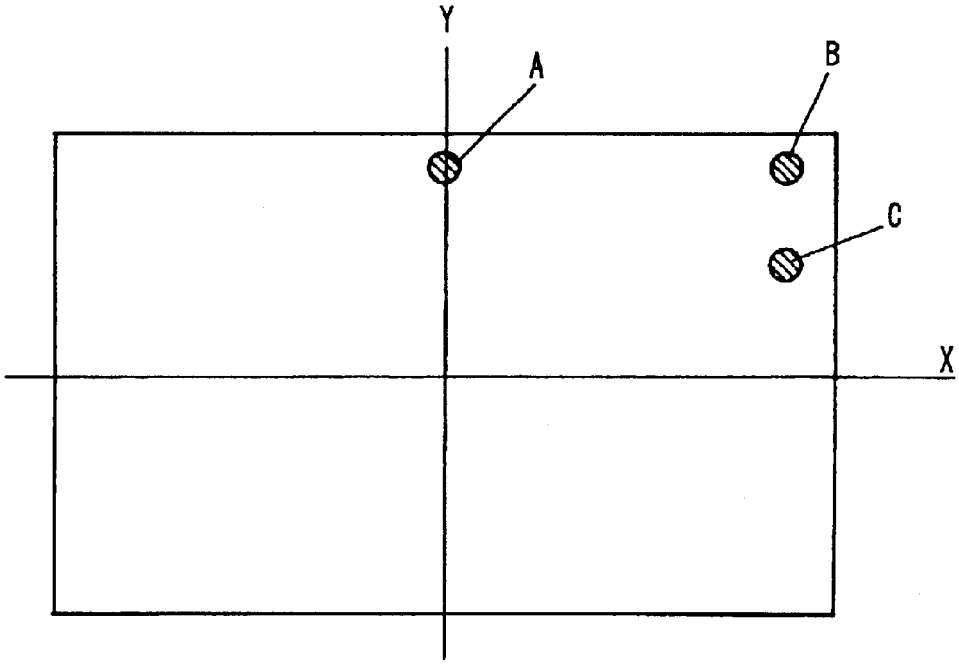
FIG. 3 is a plan view showing positions of measurement points of geomagnetism resistance characteristics on a screen in Embodiment 1 according to the present invention.

FIG. 3 shows positions of measurement points of geomagnetism resistance characteristics when the center of a screen is assumed to be origins (X, Y)=(0, 0) of the X-axis and the Y-axis in a 36-inch color cathode-ray tube apparatus with a deflection angle of 120° and an aspect ratio of 16:9. The unit of a distance is mm, and each coordinate (X, Y) is as follows: a measurement point A is (0, 200), a measurement point B is (365, 200), and a measurement point C is (365, 135). The geomagnetism resistance characteristics are represented by a movement amount of a landing position of an electron beam when a uniform magnetic field of 0.5 G is applied in the tube axis (Z-axis) direction and the horizontal (X-axis) direction. The geomagnetism resistance characteristics are symmetrical with respect to the X-axis and the Y-axis; therefore, considering only the first quadrant, the geomagnetism resistance characteristics were measured at three points: the measurement point A, the measurement point B, and the measurement point C that are most likely to be influenced by a geomagnetism.

Figure 4:
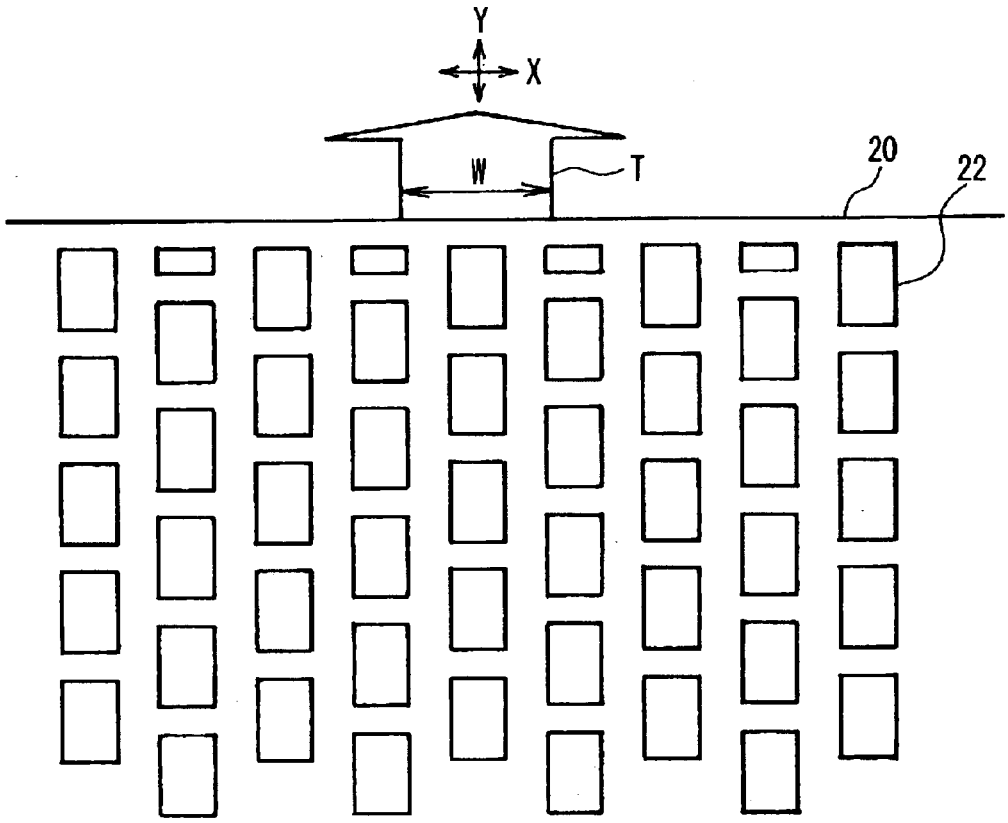
FIG. 4 is a partial view illustrating a method for applying tension in Embodiment 1 according to the present invention.
Figure 5:
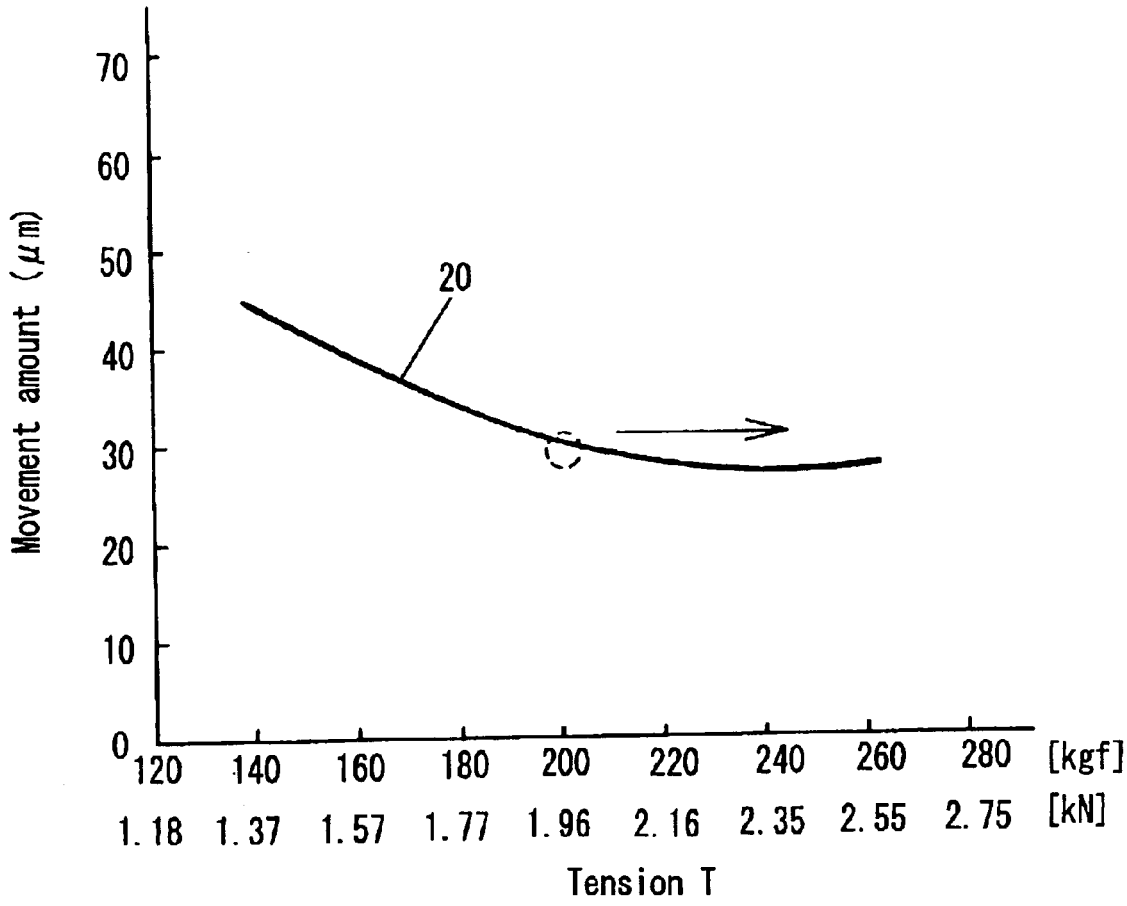
FIG. 5 is a diagram showing a relationship between the tension at a measurement point A and the movement amount of a landing position of an electron beam caused by a geomagnetism in Embodiment 1 according to the present invention.
Figure 6:
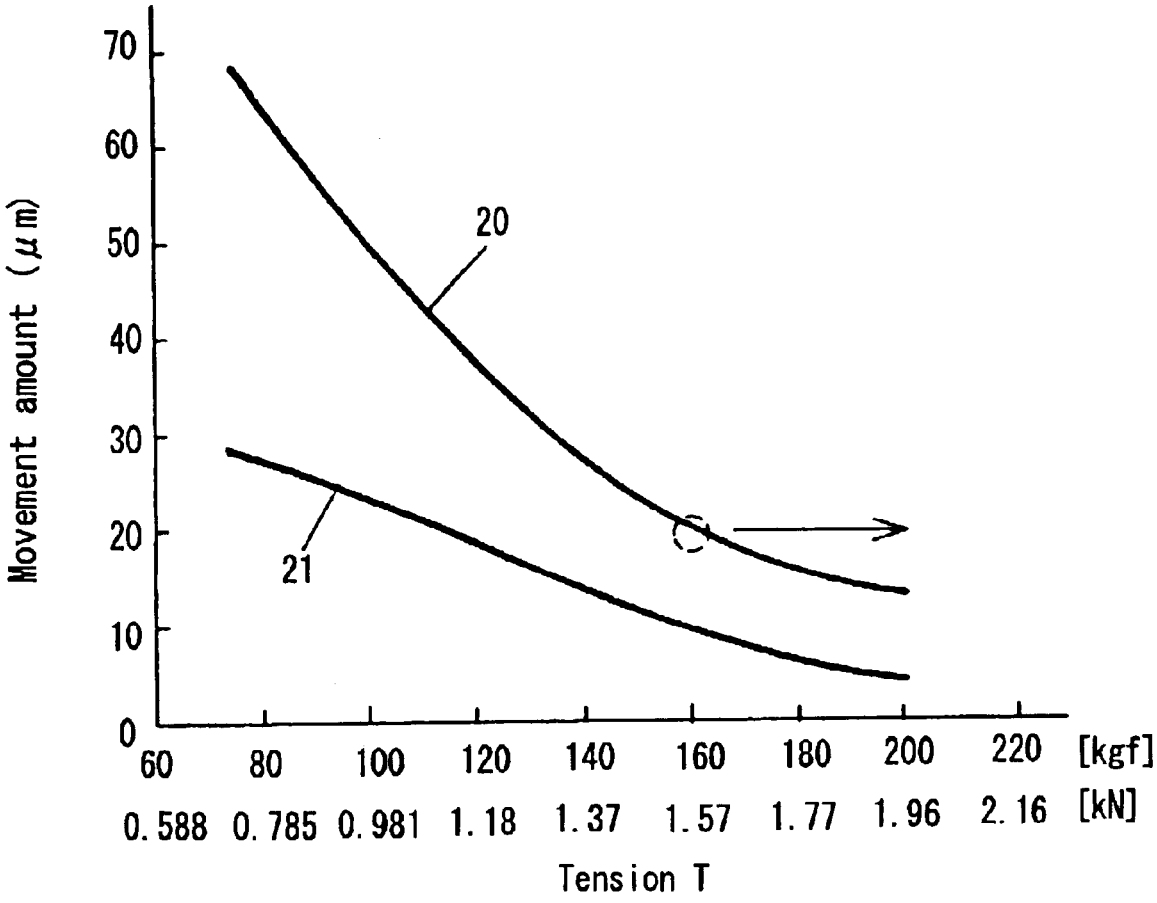
FIG. 6 is a diagram showing a relationship between the tension at a measurement point B and the movement amount of a landing position of an electron beam caused by a geomagnetism in Embodiment 1 according to the present invention.
Figure 7:
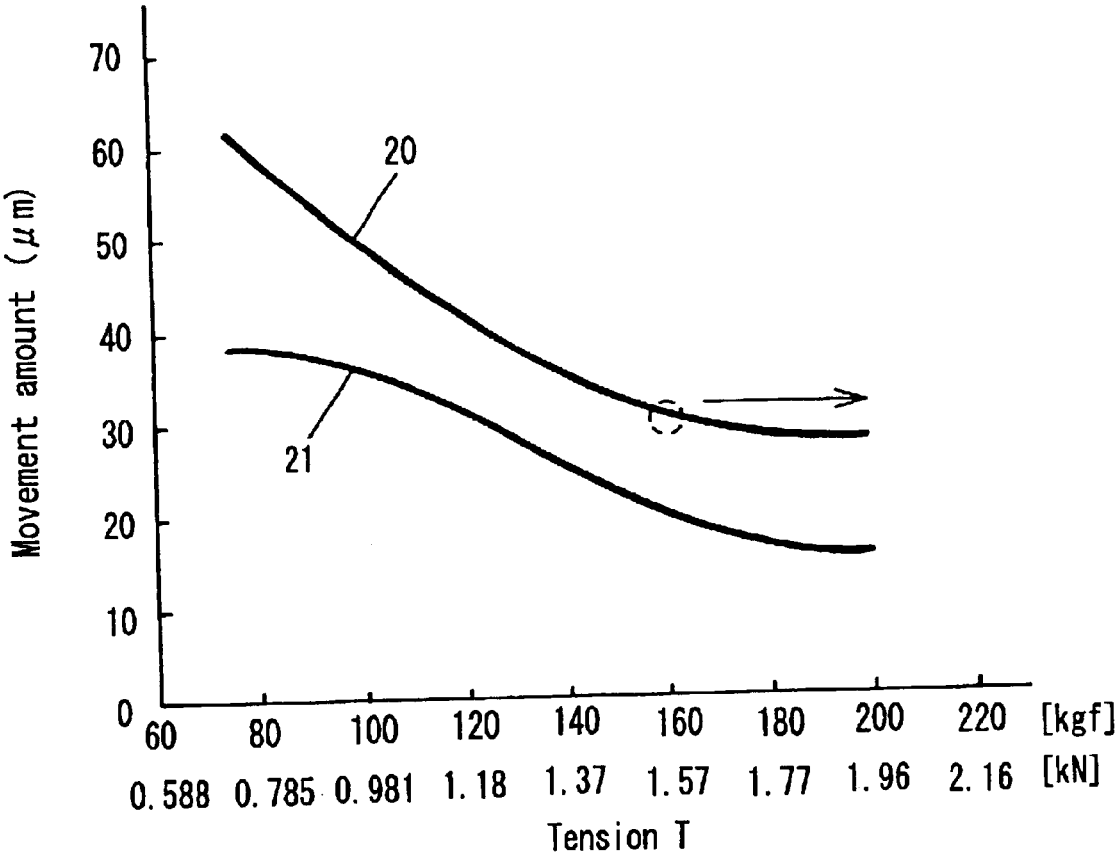
FIG. 7 is a diagram showing a relationship between the tension at a measurement point C and the movement amount of a landing position of an electron beam caused by a geomagnetism in Embodiment 1 according to the present invention.

FIG. 5 shows a result at the measurement point A, FIG. 6 shows a result at the measurement point B, and FIG. 7 shows a result at the measurement point C. In FIGS. 5 to 7, the horizontal axis represents the total of tensions T applied to the shadow mask 20 using an Invar material with a thickness of t=0.12 mm as shown in FIG. 4, in a range of a width W=700 mm in the X-axis direction. Furthermore, the vertical axis represents a movement amount of a landing position of an electron beam when each tension T is applied. A curve 20 represents a movement amount when the magnetic field in the tube axis direction is applied, and a curve 21 represents a movement amount when the magnetic field in the horizontal direction (X direction) is applied. Only in FIG. 5, the influence of the magnetic field in the horizontal direction is negligibly small on the central axis of the screen; therefore, only the result in the case of applying the magnetic field in the tube axis direction is shown.

As is understood from FIGS. 5, 6, and 7, a movement amount of a landing position becomes smaller as tension is increased at all the measurement points A, B, and C. At the measurement point A in the center portion of the X-axis direction shown in FIG. 5, the downturn of the curve 20 is substantially saturated in a range of tension of 1.96 kN (200 kgf) or more, and a change in a movement amount of a landing position becomes 3 $\mu$m or less, which is a measurement error, with respect to a change in tension of 0.098 kN (10 kgf). It was found that at the measurement points B and C in the peripheral portions of the X-axis direction shown in FIGS. 6 and 7, the downturn of the curves 20 and 21 is substantially saturated in a range of tension of 1.57 kN (160 kgf) or more.

It was confirmed in the above experiment that the coordinate of the measurement point A in the X-axis direction is X=0; however, substantially the same result as that at the measurement point A can be obtained in a range of $-20 \leqq X \leqq 20$.

Thus, from the above result, it was found that the tension needs to be 1.96 kN (200 kgf) or more in the center portion of the screen in the X-axis direction, and the tension needs to be 1.57 kN (160 kgf) or more in the peripheral portions on both sides of the X-axis direction excluding the center portion in order to obtain satisfactory geomagnetism resistance characteristics.

When tension to be applied is larger, a stronger frame for supporting the tension is required, and the weight of the frame tends to be increased accordingly. Since the minimum tension amount required for obtaining satisfactory geomagnetism resistance characteristics is obtained as described above, sufficient geomagnetism resistance characteristics can be obtained while the strength and weight of the frame are suppressed.

In the above experiment, the case where the thickness of the shadow mask is 0.12 mm has been described. It also was confirmed that the same characteristics as those in the above can be obtained if the thickness is 0.15 mm or less.

The above result is converted to a stress P (MPa) per unit area as follows. As shown in FIG. 4, assuming that the thickness of the shadow mask 20 is t, the range in the X-axis direction of applying the tension T is W, and the ratio of a total value of the widths of the apertures 22 with respect to the width of the shadow mask 20 in the X-axis direction is R (bridge portion is ignored), the stress P is represented by the following Expression (1).

$$P=T/(t\times W\times(1-R)) \quad (1)$$

In the above experiment, R=0.28.

When the respective conditions in which tension is 1.96 kN (200 kgf) or more in the center portion and tension is 1.57 kN (160 kgf) or more in the peripheral portions are converted to the stress P per unit area in accordance with the above definition, the stress becomes 32 MPa or more in the center portion, and the stress becomes 26 MPa or more in the peripheral portion. Because of this, irrespective of the thickness of a mask, a stress distribution condition in the X-axis direction required for obtaining satisfactory geomagnetism resistance characteristics was obtained.

(Embodiment 2)

In the present embodiment, the shadow mask 20 is made of a Fe—Ni alloy. Preferably, the supporting members 31*a* and 31*b* constituting the longitudinal sides of the frame 30 also are made of a Fe—Ni alloy. More preferably, the content of Ni (nickel) in the Fe—Ni alloy is 36.1±0.3%. The Fe—Ni alloy may contain a trace amount of inevitable impurity. Such a Fe—Ni alloy is known as an Invar alloy, and has a small thermal expansion coefficient. Therefore, the Fe—Ni alloy can decrease a mislanding amount caused during heating with an electron beam.

Furthermore, in the present embodiment, the tension (tensile stress) T applied to the shadow mask 20 under the condition of being stretched on the frame 30 is 29 MPa or more, preferably 90 MPa or less. Hereinafter, this will be described.

Figure 8:
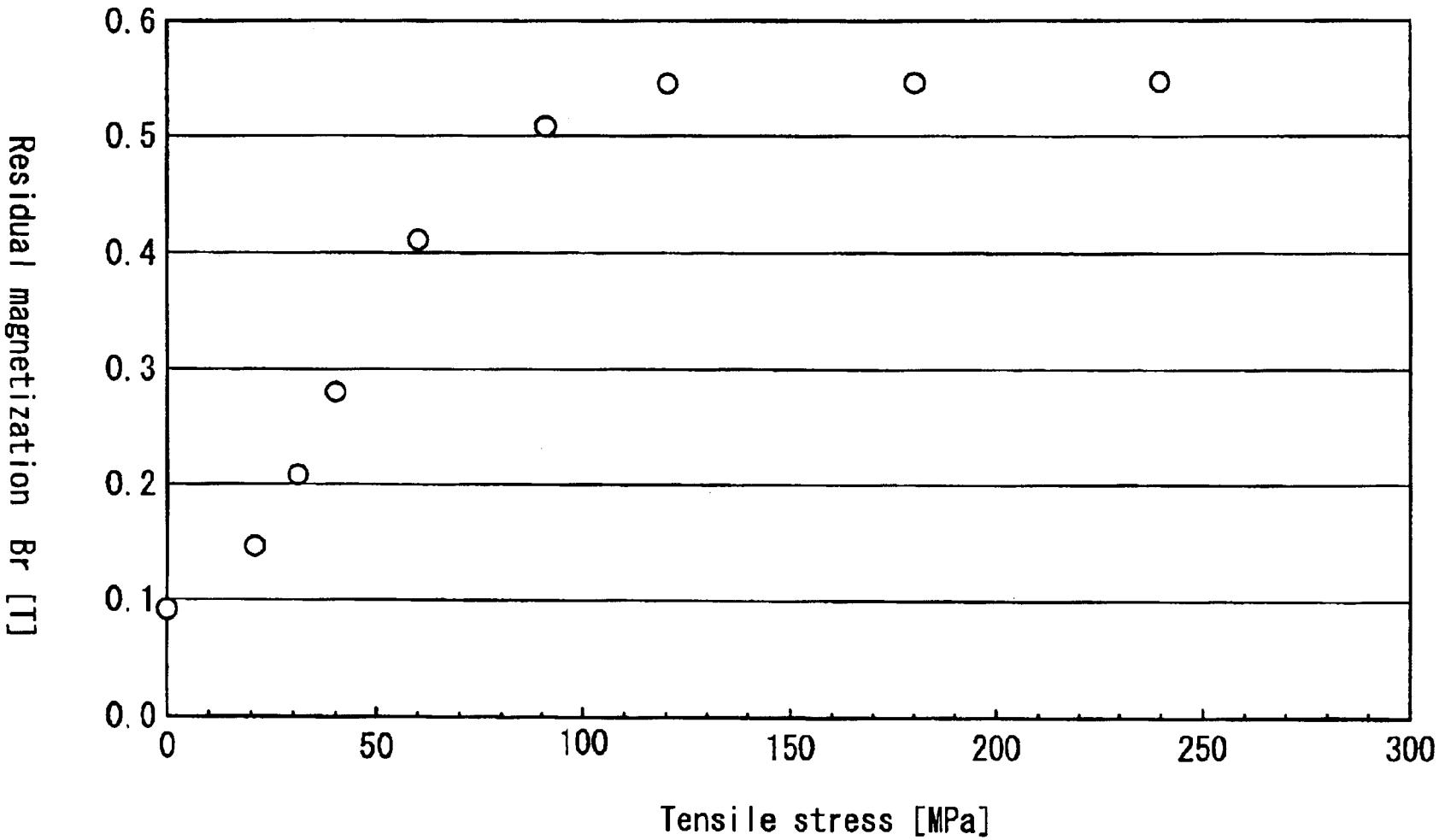
FIG. 8 shows an experimental result showing the state of a change in residual magnetization when a tensile stress is applied to a flat plate made of a Fe—Ni alloy in Embodiment 2 according to the present invention.

FIG. 8 shows an experimental result of a state of a change in residual magnetization when a tensile stress is applied to a flat plate made of a Fe—Ni alloy (the content of Ni is 36.1±0.3%) according to the present invention. In FIG. 8, the horizontal axis represents a tensile stress, and the vertical axis represents residual magnetization Br.

A method for measuring the residual magnetization Br will be described with reference to FIG. 9. A metal flat plate (subject material) 101 with a length of 300 mm and a width of 5 mm is suspended. A weight 103 is connected to a lower end of the metal flat plate 101, whereby a desired tension (tensile stress) is applied to the metal flat plate 101. A detection coil 107 wound in a solenoid shape is placed inside of an exciting coil 105 wound in a solenoid shape. Then, the metal flat plate 101 is inserted inside of the detection coil 107. In this state, the residual magnetization of the metal flat plate 101 was measured by the detection coil 107 in the case of flowing a current through the exciting coil 105 to apply an external magnetic field of 398 A/m.

Figure 9:
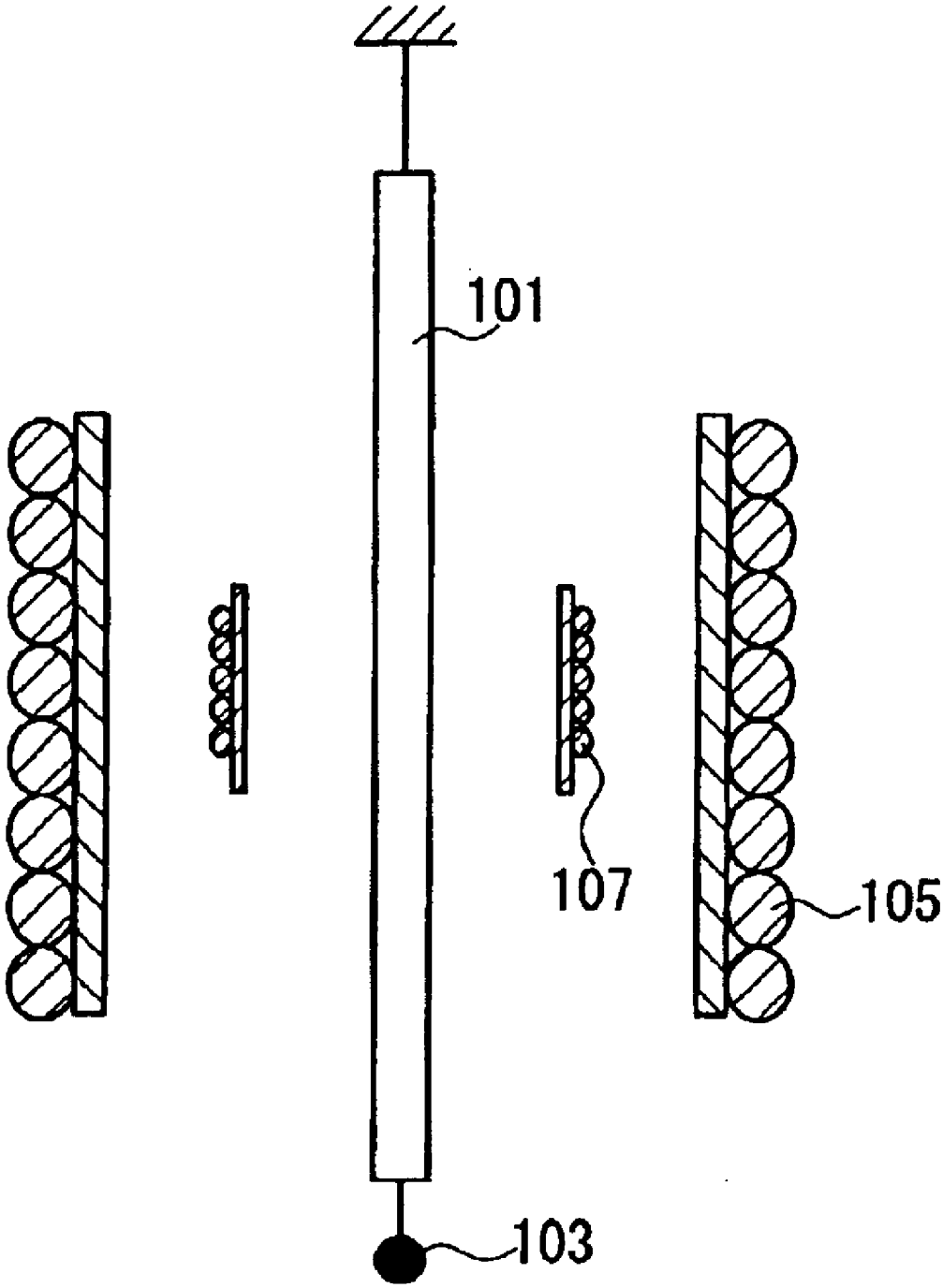
FIG. 9 is a cross-sectional view schematically showing an apparatus for measuring residual magnetization shown in FIG. 8.

In the measurement shown in FIGS. 8 and 9, it is assumed that the shadow mask with tension applied thereto is stretched. As is understood from FIG. 8, the residual magnetization Br is increased as the tensile stress to be applied is increased. The residual magnetization Br represents the ease of magnetization. A large value of the residual magnetization Br means that a magnetic flux is likely to be absorbed, i.e., magnetic shield characteristics are satisfactory. Therefore, it is understood that in the case where the Fe—Ni alloy is used as a shadow mask material, as tension to be applied is increased, the magnetic shield characteristics of the shadow mask are enhanced.

Figure 10:
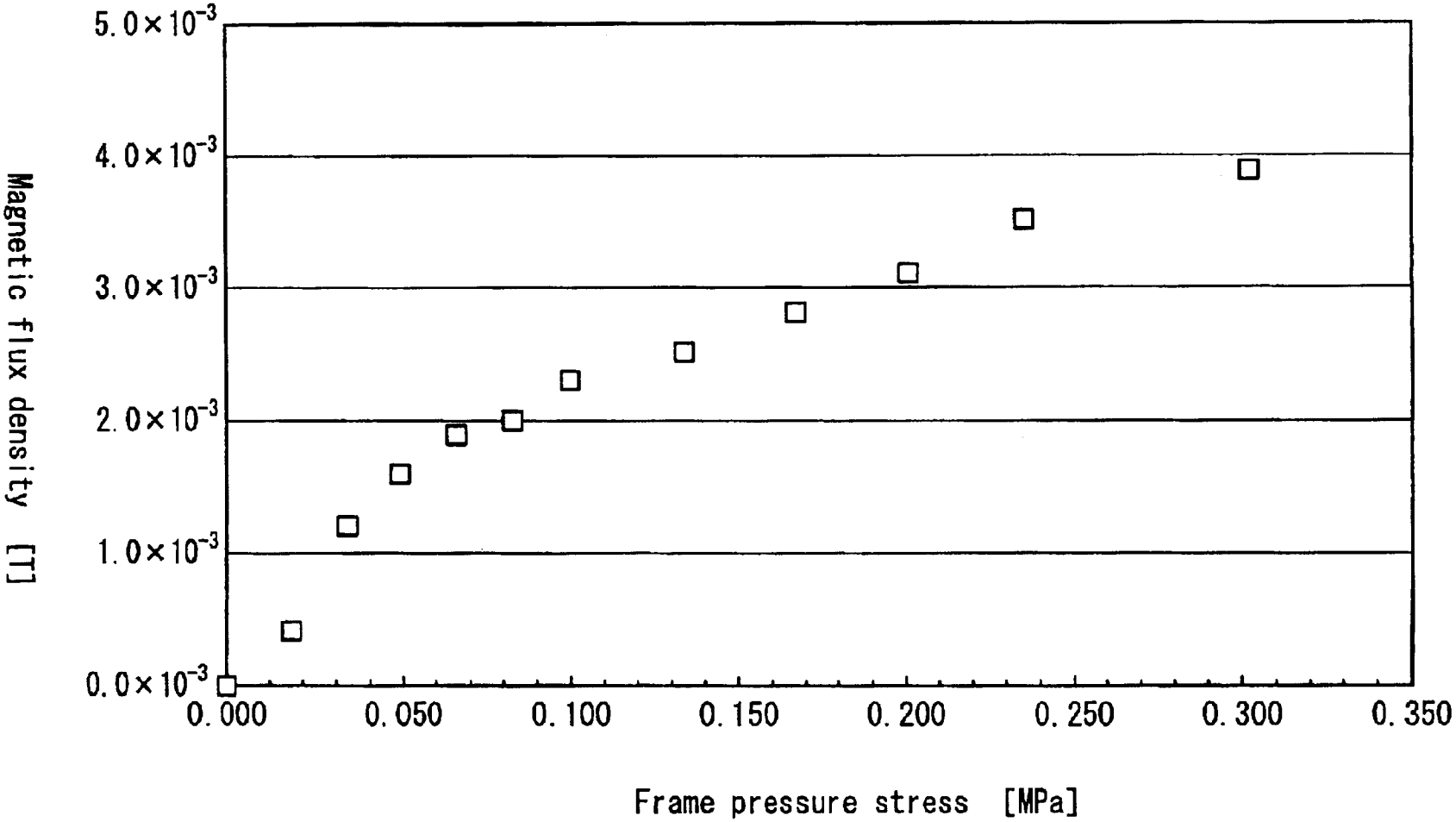
FIG. 10 shows an experimental result showing the state of a change in a magnetic flux leaking from a frame when pressure in directions approaching each other is applied to opposed supporting members of a frame produced by using a Fe—Ni alloy in Embodiment 2 according to the present invention.

Next, FIG. 10 shows an experimental result of a state of a change in a magnetic flux leaking from a frame when pressure in directions approaching each other is applied to the opposed supporting members 31*a* and 31*b* of the frame 30 produced by using a Fe—Ni alloy according to the present invention. In FIG. 10, the horizontal axis represents a pressure stress applied to the supporting members 31*a* and 31*b*, and the vertical axis represents the density of a magnetic flux leaking from the frame.

Figure 11:
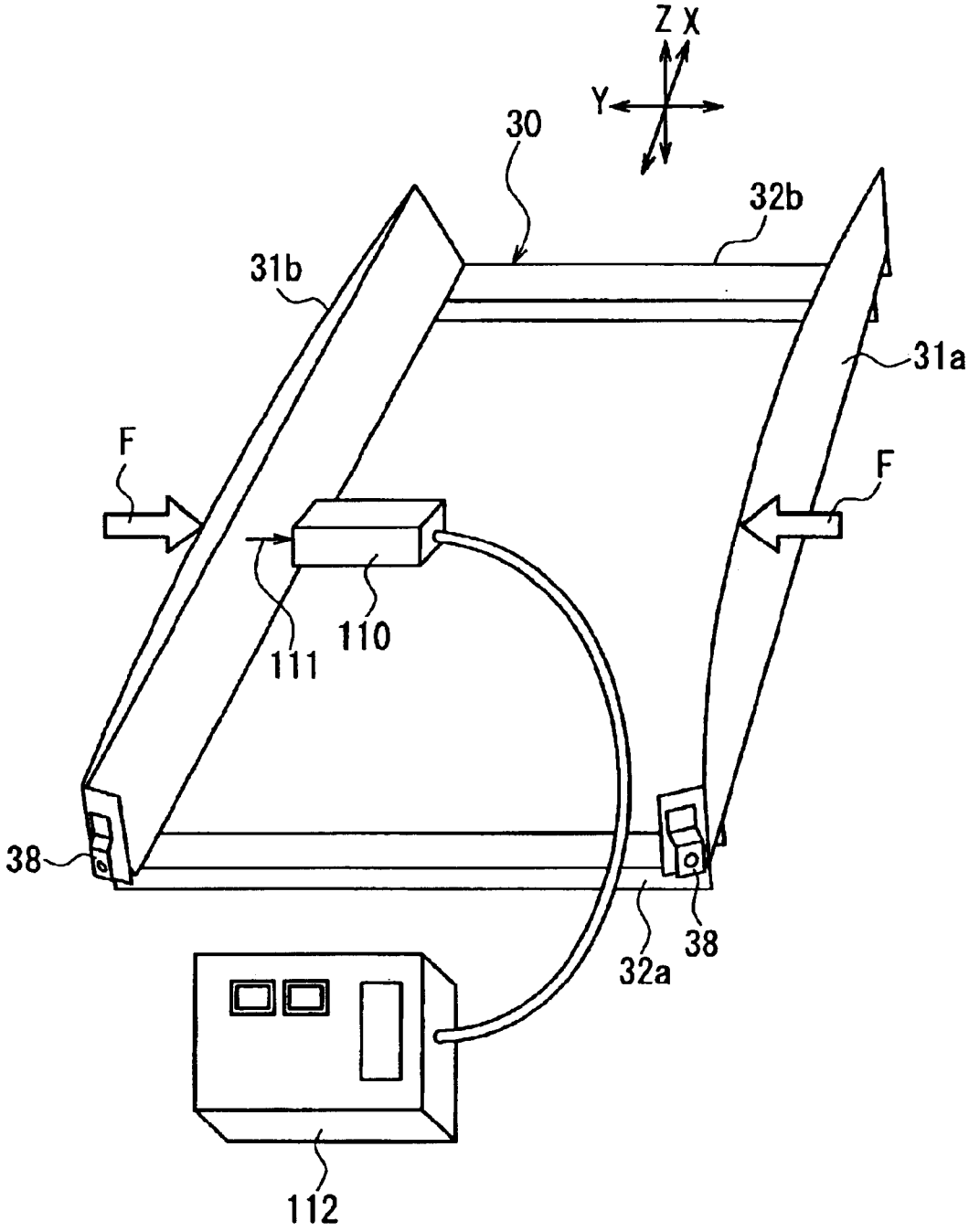
FIG. 11 is a perspective view schematically showing an apparatus for measuring a magnetic flux density shown in FIG. 10.

A method for measuring a magnetic flux density will be described with reference to FIG. 11. The frame 30 for a 36-inch color cathode-ray tube was produced by using a Fe—Ni alloy. Herein, the material for the supporting members 31*a* and 31*b* constituting the longitudinal sides of the frame 30 contains 36% Ni, and the material for the connecting members 32*a* and 32*b* constituting the short sides of the frame 30 contains 42% Ni. The frame 30 was placed in an apparatus to be used for welding and stretching a shadow mask. Then, in the same way as in stretching the shadow mask, pressure F in directions approaching each other was applied to the opposed supporting members 31*a* and 31*b*. A change in a magnetic flux 111 leaking from the center portion of the supporting member 31*b* in the longitudinal direction when the pressure F is changed in a range of 0 to 0.3 MPa (converted value to a stress) was measured by a sensor 110 for measuring a magnetic flux density. Reference numeral 112 denotes a magnetic flux density measurement apparatus (Fluxgate magnetometer FGM-3D2 produced by WALKER SCIENTIFIC INC.) that calculates and outputs a magnetic flux density based on a signal from the sensor 110. The pressure stress represented by the horizontal axis in FIG. 10 is obtained by dividing the total pressure applied to the supporting members 31*a* and 31*b* by an area of potions of the supporting members to which the shadow mask is welded (end faces of the supporting members substantially parallel to a Y-axis, to which the shadow mask is welded).

As is understood from FIG. 10, as a frame pressure stress is increased, the density of a magnetic flux leaking from the frame is increased. A magnetic flux leaking from the frame corresponds to a leaked external magnetic field mainly containing a geomagnetism absorbed by the frame. That is, a large density of a magnetic flux leaking from the frame means that an external magnetic field is likely to be absorbed by the frame, i.e., the magnetic shield characteristics are satisfactory. Thus, the following is understood: in the case where a Fe—Ni alloy is used as a frame material, as pressure to the supporting members 31*a* and 31*b* of the frame is increased (i.e., as the tension of the shadow mask to be stretched is increased), the magnetic shield characteristics of the frame are enhanced.

Figure 12:
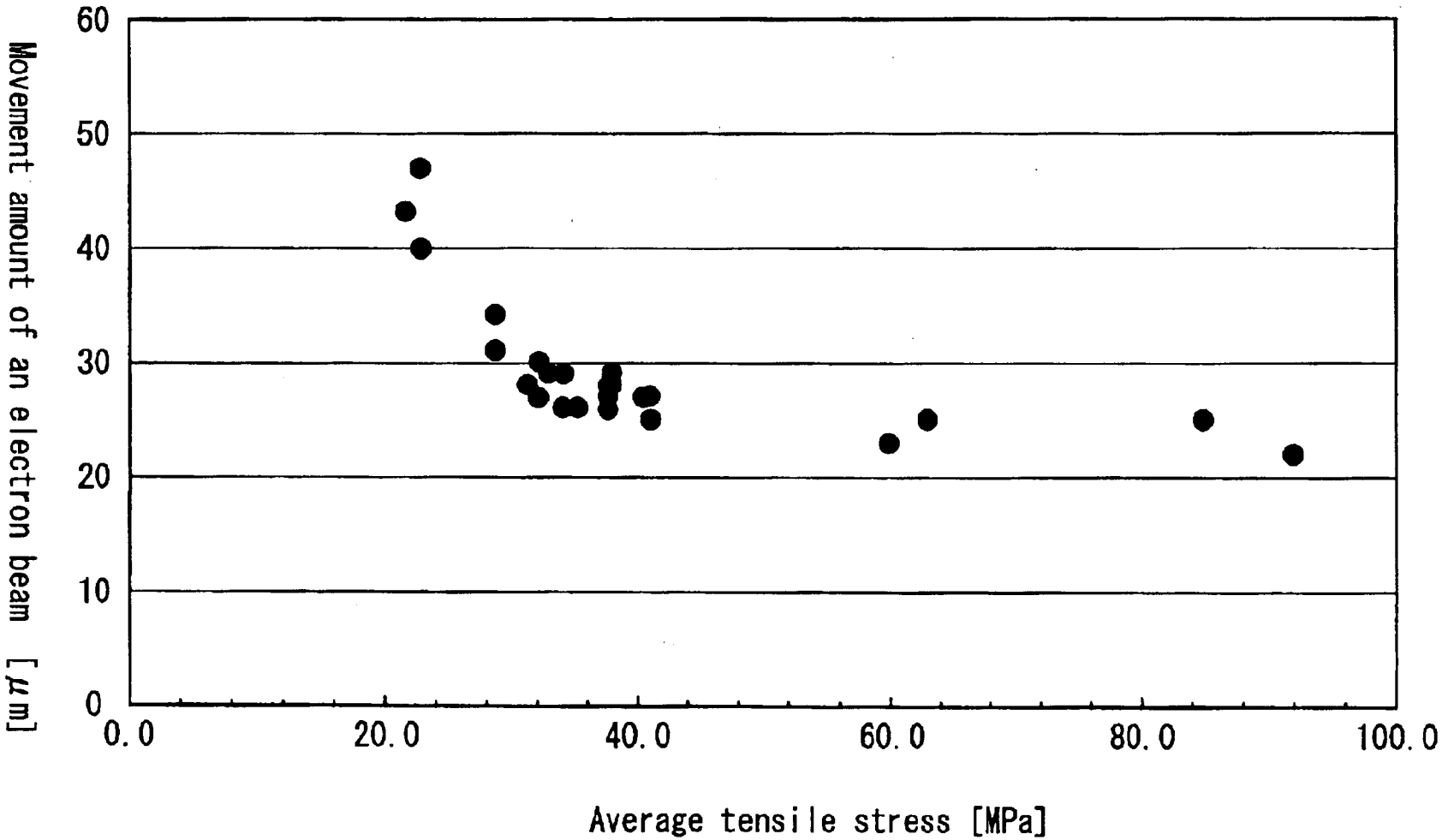
FIG. 12 is a diagram showing a result obtained by measuring a mislanding amount of an electron beam caused by a geomagnetism in a 36-inch color cathode-ray tube in which a shadow mask and a frame are produced by using a Fe—Ni alloy in Embodiment 2 according to the present invention.

Based on the above finding, the shadow mask 20 and the supporting members 31*a* and 31*b* of the frame 30 were produced by using a Fe—Ni alloy containing 36% Ni, the connecting members 32*a* and 32*b* of the frame 30 were produced by using a Fe—Ni alloy containing 42% Ni, and the applied tension of the shadow mask 20 was varied, whereby a 36-inch color cathode-ray tube was produced, and a movement amount (mislanding amount) of a landing position of an electron beam caused by a geomagnetism was measured. The magnitude of the geomagnetism was 0.5 G. A movement amount of a landing position of an electron beam was measured by varying the direction of a color cathode-ray tube and the measurement points on the screen, and the maximum value was set to be a movement amount at its corresponding applied tension. The result is shown in FIG. 12. In FIG. 12, the horizontal axis represents an average tensile stress applied to a shadow mask in a stretched state, and the vertical axis represents a movement amount (mislanding amount) of a landing position of an electron beam on a phosphor screen. Herein, an average tensile stress was obtained by the above-mentioned Expression (1), assuming that a stress distribution was constant in an X-axis direction.

It is understood from FIG. 12 that when a shadow mask is stretched at an average tensile stress of 29 MPa or more, the movement amount of an electron beam is decreased significantly (by about 40% compared with the case where an average tensile stress is about 20 MPa). Thus, in a range of this applied tension, mislanding of an electron beam is decreased, and a color shift is suppressed, whereby a satisfactory color image can be displayed.

If the average tensile stress when the shadow mask is stretched is 29 MPa or more, mislanding of an electron beam can be suppressed. However, when applied tension is increased to a certain degree or more, a configuration for withstanding large applied tension needs to be designed, which increases a weight and a cost. Furthermore, the vibration damping property of the shadow mask is degraded. Thus, it is preferable that an average tensile stress is 90 MPa or less when the shadow mask is stretched.

In the above embodiment, an example has been described in which the shadow mask 20 and the supporting members 31*a* and 31*b* of the frame 30 are made of a Fe—Ni alloy containing 36% Ni. According to the study by the inventors, the above-mentioned characteristics "as an applied stress is increased, the magnetic shield characteristics become more satisfactory" are not limited to a Fe—Ni alloy containing 36% Ni. The same characteristics are obtained in other Fe—Ni alloys with different compositions (e.g., containing 42% Ni, or the like). Furthermore, these Fe—Ni alloys have the common characteristics of a smaller thermal expansion coefficient compared with pure iron.

Thus, the present invention is not limited to a Fe—Ni alloy containing 36% Ni exemplified in the above embodiment. The same effects can be obtained even if a shadow mask (preferably, a frame, in particular, supporting members thereof) is configured using another Fe—Ni alloy.

In the case where the shadow mask 20 is made of a Fe—Ni alloy containing 36% Ni, and the supporting members 31*a* and 31*b* of the frame are made of another Fe—Ni alloy having a composition different from that of the Fe—Ni alloy of the shadow mask 20 (e.g., Fe—Ni alloy containing 42% Ni) or an iron material, inconvenience such as the breakage of the stretched shadow mask 20 and the generation of creases may be caused due to the difference in thermal expansion coefficient between the shadow mask 20 and the supporting members 31*a*, 31*b*. In order to avoid this, it is preferable that the shadow mask stretch sides of the supporting members 31*a* and 31*b* of the frame have a comb teeth structure or the like so as to absorb the difference in thermal expansion amount between the shadow mask 20 and the supporting members 31*a*, 31*b*.

Furthermore, in FIGS. 8 and 10 shown in Embodiment 2, a 36-inch color cathode-ray tube is assumed. Tensile stress values 30 MPa and 90 MPa applied to the shadow mask represented by the horizontal axis in FIG. 8 substantially correspond to pressure stress values 0.06 MPa and 0.19 MPa applied to the frame represented by the horizontal axis in FIG. 5. For example, when the shadow mask is welded and fixed on the frame under the condition that an average tensile stress of 30 MPa is applied to the shadow mask, and a pressure stress of 0.06 MPa is applied to the frame, the tension with respect to the shadow mask and the pressure with respect to the frame are balanced substantially without changing stress values applied to the shadow mask and the frame. Thus, under the condition that the shadow mask is stretched and held on the frame, the degree of stretching can be expressed by a tensile stress applied to the shadow mask. Alternatively, the degree of stretching also can be expressed by a pressure stress applied to the frame.

The embodiments described above are intended to clarify the technical contents of the present invention. The present invention should not be interpreted only based on such specific examples, and can be varied within the spirit of the present invention and the scope of the claims. Thus, the present invention should be interpreted in a broad sense.

What is claimed is:

1. A color cathode-ray tube, comprising:

a shadow mask on which a number of apertures for allowing an electron beam to pass through are formed; and a frame for stretching and holding the shadow mask with tension applied thereto in one direction, wherein the shadow mask is made of an Invar material, and a stress generated in the shadow mask by the tension is 32 MPa or more in a range of ±20 mm with respect to a center position of the shadow mask in a direction orthogonal to a direction in which the tension is applied, and is 26 MPa or more outside the range.

2. A color cathode-ray tube, comprising:

a shadow mask on which a number of apertures for allowing an electron beam to pass through are formed; and a frame for stretching and holding the shadow mask with tension applied thereto in one direction, wherein the shadow mask is made of a Fe—Ni alloy, and the shadow mask is stretched and held at an average tensile stress of 29 MPa or more.

3. The color cathode-ray tube according to claim 2, wherein the shadow mask contains 36.1±0.3% Ni.

4. The color cathode-ray tube according to claim 2, wherein a member constituting a longitudinal side of the frame is made of a Fe—Ni alloy.

5. The color cathode-ray tube according to claim 4, wherein the member constituting a longitudinal side of the frame contains 36.1±0.3% Ni.

6. The color cathode-ray tube according to claim 1, wherein an average tensile stress of the shadow mask is 90 MPa or less.

7. The color cathode-ray tube according to claim 1, wherein a total deflection angle is 115° or more.

8. The color cathode-ray tube according to claim 2, wherein an average tensile stress of the shadow mask is 90 MPa or less.

9. The color cathode-ray tube according to claim 2, wherein a total deflection angle is 115° or more.

* * * * *